US007467968B1

(12) United States Patent
Sink et al.

(10) Patent No.: US 7,467,968 B1
(45) Date of Patent: Dec. 23, 2008

(54) ELECTRICAL CONNECTOR WITH PAD HOLE LOCATOR

(75) Inventors: Joseph Sink, Wake Forest, NC (US); Peter Therrien, Bedford, NH (US); Christopher G. Chadbourne, Nashua, NH (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/895,507

(22) Filed: Aug. 24, 2007

(51) Int. Cl.
*H01R 3/00* (2006.01)

(52) U.S. Cl. ..... 439/491; 439/883

(58) Field of Classification Search ..... 439/488, 439/491, 883, 907
See application file for complete search history.

(56) References Cited

U.S. PATENT DOCUMENTS

| | | | | |
|---|---|---|---|---|
| 4,495,480 | A | 1/1985 | Martin et al. | 335/199 |
| 4,775,337 | A | 10/1988 | Van Wagener et al. | 439/883 |
| 5,960,540 | A * | 10/1999 | Pentz | 29/861 |
| 6,527,571 | B2 * | 3/2003 | Muta et al. | 439/246 |

* cited by examiner

*Primary Examiner*—Khiem Nguyen
(74) *Attorney, Agent, or Firm*—Harrington & Smith, PC

(57) ABSTRACT

Disclosed herein is a terminal connector. The terminal connector includes a first portion and a pad portion. The first portion is configured to be connected to a conductor. The pad portion is configured to be fastened to a mating terminal pad. The pad portion is connected to the first portion. The pad portion comprises pad hole location indicia for subsequently forming a thru-hole at the indicia.

20 Claims, 5 Drawing Sheets

ELECTRICAL CONNECTOR WITH PAD HOLE LOCATOR

BACKGROUND OF THE INVENTION

1. Field of the Invention

The invention relates to an electrical connector and, more particularly, to an electrical connector with a pad hole locator.

2. Brief Description of Prior Developments

Terminal connectors, or terminal lugs, are well known in the art. U.S. Pat. No. 4,775,337 discloses various terminal connector configurations. These configurations generally provide a pad or tongue portion comprising a thru hole for receiving a post from a mating component.

Electrical contractors often request or specify the purchase of 'blank tongue' or 'blank pad' connector products. These are electrical connectors which are substantially formed to their final shape either by casting, forming, or other processes. The 'blank' connector, however, is not supplied with thru-holes in the tongue or pad of the connector at the request of the user. In field installations, the user can drill thru-holes in these 'blank' lugs to the diameter and spacing which suits the application.

One drawback to this conventional configuration is that the user may not consistently place the thru-holes in the appropriate locations. An arduous process of scribing lines, measuring location, referring to drawings, and the like can be imagined which is non-productive, time consuming, and error prone.

Accordingly, there is a need for a terminal connector with 'blank' tongues or pads which facilitate field drilling.

SUMMARY OF THE INVENTION

In accordance with one aspect of the invention, a terminal connector is disclosed. The terminal connector includes a first portion and a pad portion. The first portion is configured to be connected to a conductor. The pad portion is configured to be fastened to a mating terminal pad. The pad portion is connected to the first portion. The pad portion comprises pad hole location indicia for subsequently forming a thru-hole at the indicia.

In accordance with another aspect of the invention, a terminal connector assembly is disclosed. The terminal connector assembly includes a terminal connector and a sleeve. The terminal connector includes a first portion and a pad portion. The first portion is configured to be connected to a conductor. The pad portion is configured to be fastened to a mating terminal pad. The pad portion is connected to the first portion. The sleeve is configured to be aligned with the pad portion. The sleeve includes indicia for indicating locations of holes to be subsequently formed in the pad portion.

In accordance with yet another aspect of the invention, a method of manufacturing a terminal connector is disclosed. A first portion configured to be connected to a conductor is formed. A pad portion connected to the first portion is formed. Pad hole location indicia for subsequently forming a thru hole on the pad portion are provided.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
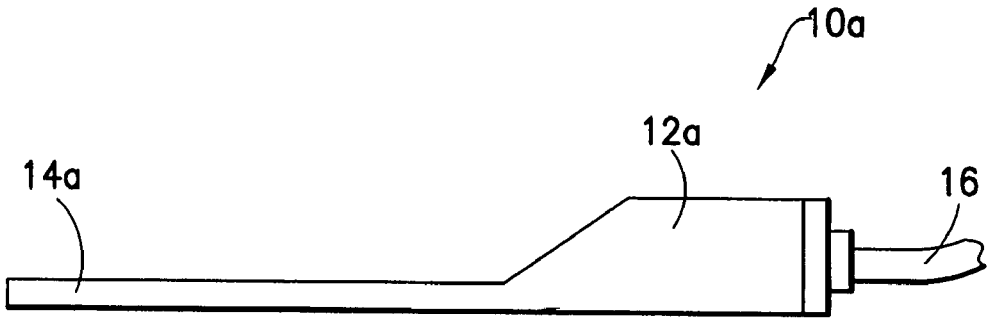
FIG. 1 is a side view of a terminal connector comprising features of the invention.

Referring to FIG. 1, there is shown a side view of a terminal connector 10*a* incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The terminal connector or lug 10*a* includes a first portion 12*a* and a pad portion 14*a*. The first portion 12*a* is connected to an electrical conductor or wire 16. The pad portion 14*a* is configured to be fastened or connected to a mating terminal pad or component 38 (shown in FIG. 9). The terminal connector 10*a* is preferably comprised of an integrally formed one-piece member made of electrically conductive material such as metal for example. In this embodiment, the terminal connector 10*a* is a compression terminal connector. In an alternate embodiment, the terminal connector 10*a* could be a mechanical terminal connector. Additionally, features of the invention could be used in any suitable type of electrical connector or electrical connector environment.

Figure 2:
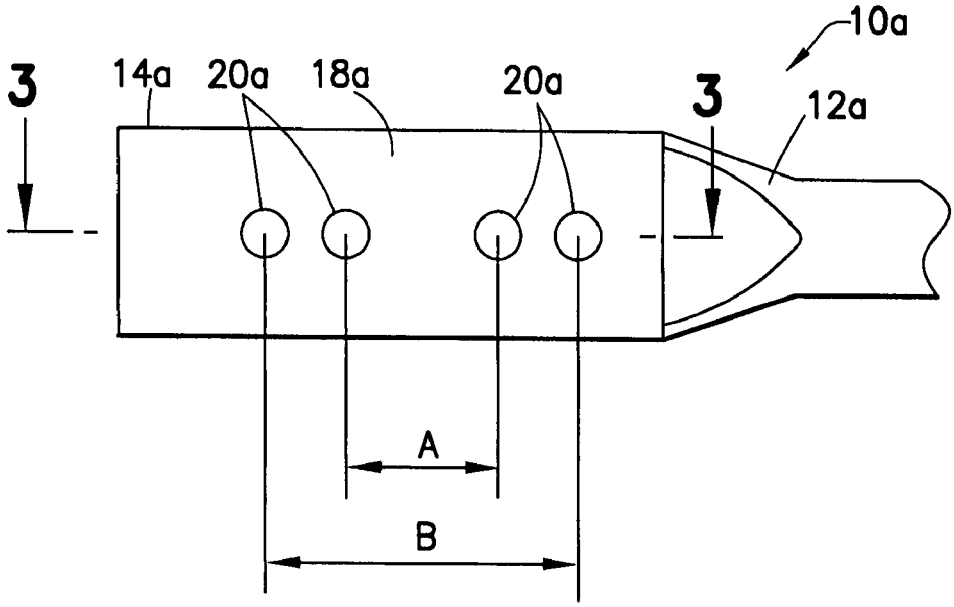
FIG. 2 is a top plan view of the terminal connector shown in FIG. 1.

Referring now to FIG. 2, there is shown a top plan view of the terminal connector 10*a* in accordance with a first embodiment of the invention. The pad portion 14*a* comprises a flat contact surface 18*a* having pad hole location indicia 20*a* for subsequently forming a thru-hole at the indicia 20*a*. The indicia 20*a* provide the user with pre-defined points on the blank lug 10*a*, at appropriate and highly standardized locations and spacing A, B (if necessary). This provides a template to the user to eliminate any guesswork in locating or spacing thru holes and to speed up the process of creating the holes for the installation of hardware and completion of the application.

Figure 3:
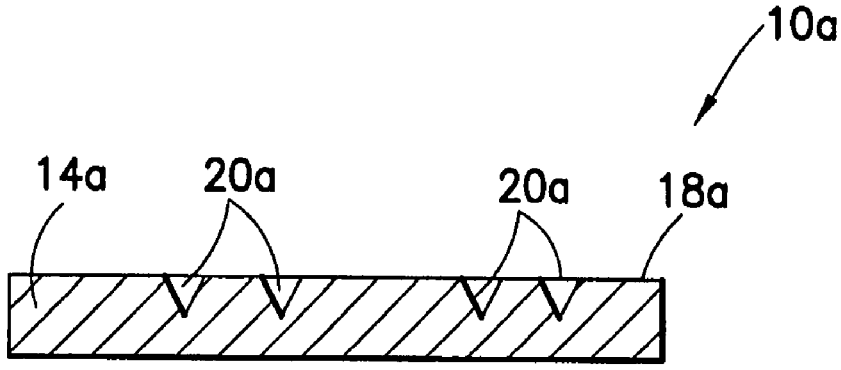
FIG. 3 is a cross section view of a pad portion of the terminal connector shown in FIG. 2.

Referring now also to FIG. 3, the indicia 20*a* locations and spacing A, B could be applied as slight surface depressions 20*a* in the flat contact surface 18*a* of the lug pad 14*a*. The indicia or surface depressions 20*a* may be provided at the two industry standard spacings A, B during the manufacture of the connector 10*a*. The surface depressions 20*a* may be applied as part of the operation which creates the lug 10*a* (designed into the tooling which forms the lug 10*a*) or as a secondary operation in the factory. This provides a finished product that has the 'locator template' (surface depressions 20*a*) ready for the contractor to use as a guide. This provides highly accurate spacing and location as it would be tooled into the fabrication of the connector 10*a* itself. In the embodiment shown, the connector 10*a* has four surface depressions 20*a*. However, more or less surface depressions could be provided and the surface depressions 20*a* could be located at any suitable location(s).

The industry standard spacing A may be a telecommunications industry standard spacing of about 1 inch for example. The industry standard spacing B may be a utility/consumer industry standard spacing of about 1.75 inch for example. However, any suitable indicia spacing and/or location may be provided.

Figure 4:
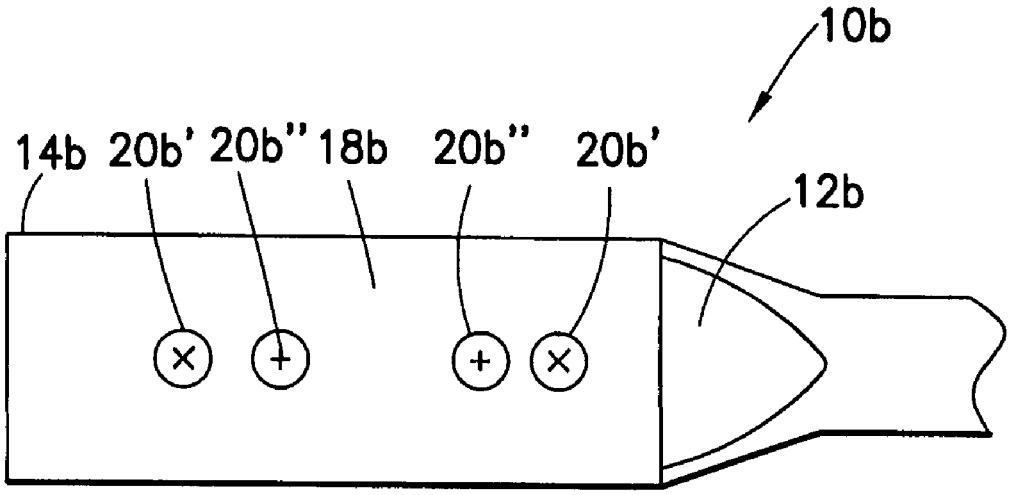
FIG. 4 is a top plan view of an alternative terminal connector.

Referring now to FIG. 4, there is shown a top plan view of a terminal connector 10*b* in accordance with a second embodiment of the invention. The terminal connector 10*b* is similar to the terminal connector 10*a*. One difference between the terminal connector 10*b* and the terminal connector 10*a* is that the terminal connector 10*b* does not comprise surface depressions. Instead, the connector 10*b* comprises pad hole location indicia which may be applied as surface markings 20*b*', 20*b*".

The spacing and location of the indicia 20*b*', 20*b*" would be defined by the application of the surface markings in the flat contact surface 18*b* of the lug pad 14*b*. The indicia or surface markings 20*b*', 20*b*" could be stenciled or painted characters such as "X" for 20*b*' for example, and such as "+" for 20*b*" for example. The surface markings 20*b*', 20*b*" could also be stenciled or painted 'dots' at the appropriate location. These 'dots' could be color coded in the factory to indicate which 'dot' correlated to which spacing A, B.

It should be noted that in an alternative embodiment, the markings 20*b*', 20*b*" (or color coded dots) could be provided at the surface depressions 20*a* shown in FIGS. 2 and 3. This would provide for easily distinguishable drill points at the pad portion.

Figure 5:
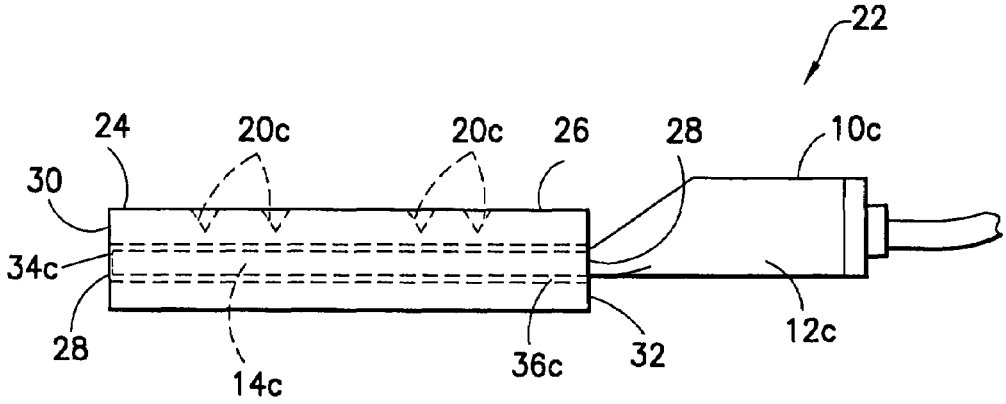
FIG. 5 is a side view of a terminal connector assembly.

Referring now to FIG. 5, there is shown a side view of a terminal connector assembly 22 in accordance with a third embodiment of the invention. The terminal connector assembly 22 comprises a terminal connector 10*c* and a sleeve 24. The terminal connector 10*c* is similar to the terminal connectors 10*a*, 10*b*. One difference between the terminal connector 10*c* and the terminal connectors 10*a*, 10*b* is that the terminal connector 10*c* does not comprise surface depressions 20*a* or surface markings 20*b*', 20*b*". Instead, pad hole location indicia 20*c* are applied to the sleeve 24.

The sleeve 24 comprises an outer surface 26 and an opening 28. The opening 28 extends between opposite ends 30, 32 of the sleeve 24. The opening 28 is suitably sized and shaped to receive a pad portion 14*c* of the connector 10*c*. When the sleeve 24 is fitted over the pad portion 14*c*, the sleeve 24 may key off, or align with, either a front end 34*c* or a back end 36*c* of the pad portion 14*c*. It should be noted that although the figures illustrate the sleeve as having two open ends 30, 32, alternate embodiments may provide a sleeve comprising only one open end.

Figure 6:
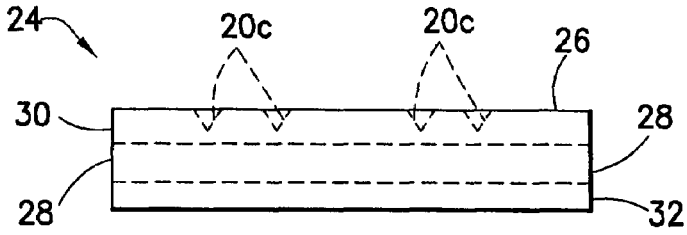
FIG. 6 is a side view of a sleeve of the terminal connector assembly shown in FIG. 5.
Figure 7:
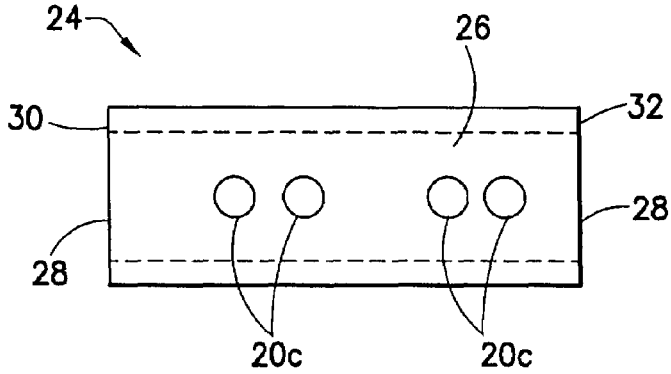
FIG. 7 is a top plan view of the sleeve shown in FIG. 6.

Referring now also to FIGS. 6 and 7, the sleeve 24 comprises the indicia locations applied as slight surface depressions 20*c* on the outer surface 26 of the sleeve 24. The sleeve or reusable mask 24 overlays the lug 10*c* at the pad portion 14*c*. The surface depressions 20*c* provide a template for subsequently forming a thru hole at the indicia and through the pad portion 14*c*. The template sleeve 24 may be made from a material which is readily drilled through, and perhaps could be used on multiple occasions, but would be semi-disposable.

Figure 8:
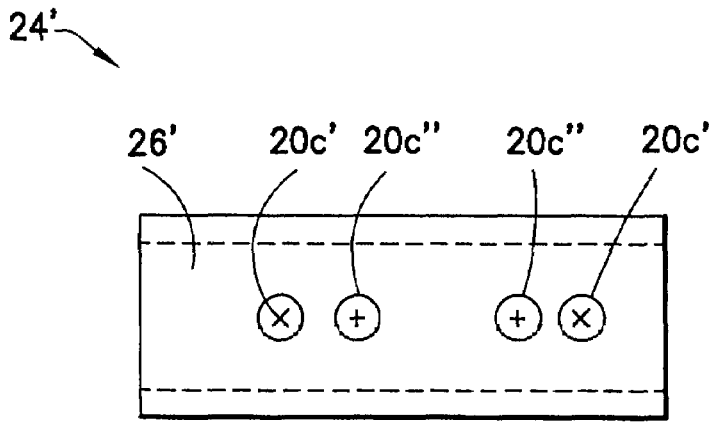
FIG. 8 is a top plan view of an alternative sleeve.

Referring now to FIG. 8, there is shown a top plan view of an alternate sleeve 24'. The sleeve 24' is similar to the sleeve 24. One difference between the sleeve 24' and the sleeve 24 is that the sleeve 24' does not comprise the surface depressions 20*c*. Instead, the sleeve 24' comprises pad hole location indicia which may be applied as surface markings 20*c*', 20*c*" (similar to the surface markings 20*b*', 20*b*" for the second embodiment shown in FIG. 4).

The spacing and location of the indicia 20*c*', 20*c*" would be defined by the application of the surface markings on the outer surface 26' of the sleeve 24'. The indicia or surface markings 20*c*', 20*c*" could be stenciled or painted characters such as "X" for 20*c*' for example, and such as "+" for 20*c*" for example. The surface markings 20*c*', 20*c*" could also be stenciled or painted 'dots' at the appropriate locations. These 'dots' could be color coded in the factory to indicate which 'dot' correlated to which spacing A, B.

It should be noted that in an alternative embodiment, the markings 20*c*', 20*c*" (or color coded dots) could be provided at the surface depressions 20*c* shown in FIGS. 5-7. This would provide for easily distinguishable drill points at the sleeve. Additionally, the indicia on the sleeve may also be provided as suitably spaced thru holes on the sleeve which serve as a template for subsequently forming thru holes on the pad portion 14*c*.

The indicia provides a template to the user to eliminate any guesswork in selecting a drilling location (as experienced with conventional blank terminal connectors) and speeds up the process of creating the holes within the pad portion of the connector. The drilling of the pad portion thru holes at the pad hole location indicia can be performed at the manufacturing/maintenance facility, or by a technician in field applications. The indicia provide the user with pre-defined drill points that would provide consistently located thru-holes. It should be noted that the disclosed terminal connector also allows the user to form thru holes on the pad portion at locations other than the pad hole location indicia.

Figure 9:
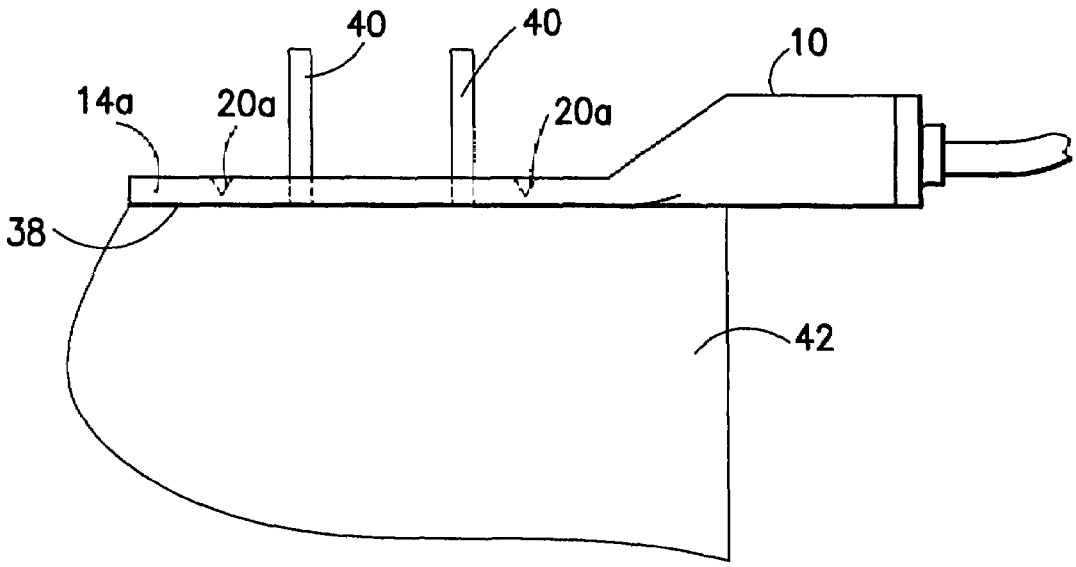
FIG. 9. is a partial side view of a the terminal connector shown in FIG. 1 connected to an electrical apparatus.

To connect the terminal connector 10*a* to a mating terminal pad 38 and/or stud 40 of an electrical apparatus 42 (as shown in FIG. 9), the pad portion 14*a* thru holes may be hand drilled at the appropriate depressions 20*a*. It should be noted only the terminal connector 10*a* is shown in FIG. 9 for the purposes of clarity. The following discussion is equally applicable to the terminal connector 10*b* or the terminal connector assembly 22 (comprising the terminal connector 10*c* and the sleeve 24). The depressions 20*a* (or markings) may provide the user with an identifiable reference, such as the character marking or color code for example, corresponding to the specific application. Additionally, the selection of the appropriate depressions (or markings) may be accomplished by aligning the depressions 20*a* (or markings) on the pad portion 14*a* to the mating terminal pad 38 and/or stud 40 of the electrical apparatus 42.

Figure 10:
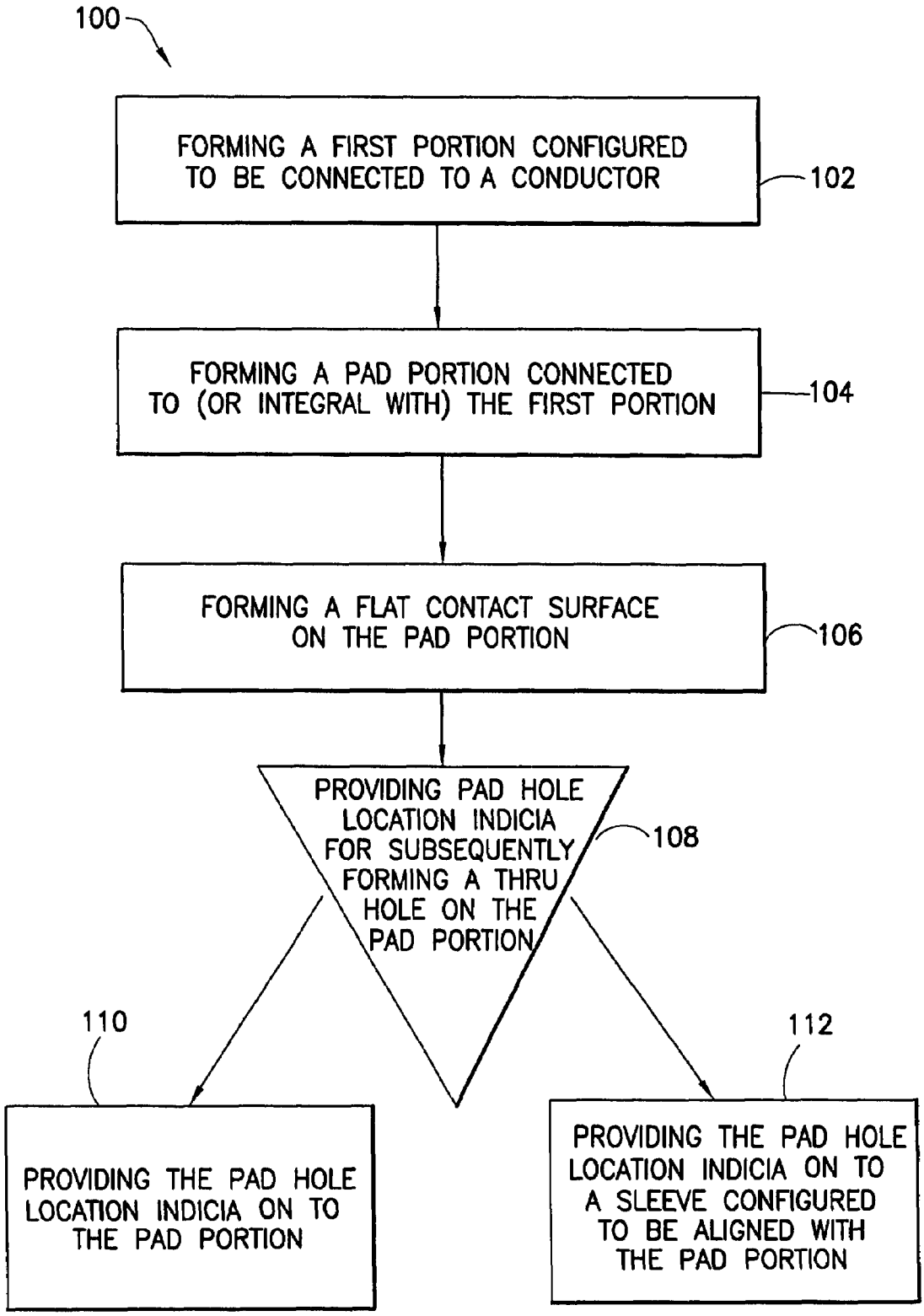
FIG. 10 is a flow chart of an exemplary method of manufacturing a terminal connector.

FIG. 10 illustrates an exemplary method 100 of manufacturing the terminal connector 10*a*, 10*b*, 10*c*. The method includes the following steps. Forming a first portion configured to be connected to a conductor (step 102). Forming a pad portion connected to (or integral with) the first portion (step 104). Forming a flat contact surface on the pad portion (step 106). Providing pad hole location indicia for subsequently forming a thru hole on the pad portion (step 108). Followed by either: providing the pad hole location indicia on to the pad portion (step 110) or providing the pad hole location indicia on to a sleeve configured to be aligned with the pad portion (step 112).

The disclosed terminal connector provides many advantages over conventional configurations. The terminal connector allows the user to drill the thru hole to the diameter and spacing which suits the application while consistently placing the thru hole at the appropriate standardized spacing. The indicia also help prevent premature mechanical failure of the terminal connector resulting from holes from being drilled too close to the edge of the pad portion, as the indicia are at predetermined locations centered within the pad portion. The disclosed terminal connector also allows users in the field or maintenance facilities to maintain lower inventories of terminal connectors, as the disclosed connector may be used for several different applications.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A terminal connector comprising;

a first portion configured to be connected to a conductor; and a pad portion configured to have thru-holes formed therein, wherein the pad portion is connected to the first portion, wherein the pad portion comprises pad hole location indicia for forming the thru-holes at the indicia, wherein the pad portion is configured to be subsequently fastened to a first mating terminal pad or a second different mating terminal pad, wherein a first portion of the indicia is configured to be aligned with the first mating terminal pad, and wherein a second portion of the indicia is configured to be aligned with the second different mating terminal pad.

2. The terminal connector of claim 1 wherein the pad hole location indicia are surface markings.

3. The terminal connector of claim 1 wherein the pad hole location indicia are surface depressions.

4. The terminal connector of claim 3 wherein the pad hole location indicia are color coded surface depressions.

5. The terminal connector of claim 1 wherein the pad portion is integrally formed with the first portion.

6. The terminal connector of claim 1 wherein the pad portion comprises a flat contact surface.

7. The terminal connector of claim 1 wherein the pad hole location indicia are spaced at a predetermined distance.

8. A terminal connector assembly comprising:

a terminal connector comprising a first portion and a pad portion, wherein the first portion is configured to be connected to a conductor, wherein the pad portion is configured to be fastened to a mating terminal pad, and wherein the pad portion is connected to the first portion; and a sleeve configured to be aligned with the pad portion, wherein the sleeve comprises indicia for indicating locations of holes to be subsequently formed in the pad portion.

9. The terminal connector assembly of claim 8 wherein the pad hole location indicia are surface markings.

10. The terminal connector assembly of claim 8 wherein the pad hole location indicia are surface depressions.

11. The terminal connector assembly of claim 8 wherein the pad hole location indicia are spaced at a predetermined distance.

12. The terminal connector assembly of claim 8 wherein the pad portion is integrally formed with the first portion.

13. The terminal connector assembly of claim 8 wherein the pad portion comprises a flat contact surface.

14. The terminal connector assembly of claim 8 wherein the sleeve is removable.

15. The terminal connector assembly of claim 8 wherein the sleeve is reusable.

16. A method of manufacturing a terminal connector comprising:

forming a first portion configured to be connected to a conductor;

forming a pad portion connected to the first portion; and providing pad hole location indicia for subsequently forming a thru hole on the pad portion, wherein the indicia comprise a first spacing between a first set of the indicia and a second spacing between a second set of the indicia, wherein the first spacing is configured to correspond to a first mating component, and wherein the second spacing is configured to correspond to a second different mating component.

17. The method of claim 16 wherein the providing of the pad hole location indicia further comprises providing the pad hole location indicia on to the pad portion.

18. The method of claim 16 wherein the providing of the pad hole location indicia further comprises providing the pad hole location indicia on to a sleeve configured to be aligned with the pad portion.

19. The method of claim 16 wherein the forming of the first portion and the pad portion further comprises integrally forming the first portion with the pad portion.

20. The method of claim 16 further comprising forming a flat contact surface on the pad portion.

* * * * *